United States Patent [19]

Tell

[11] 4,021,164

[45] May 3, 1977

[54] PUMP HAVING RECIPROCATING PUMPING MEANS

[75] Inventor: Hans Peter Tell, Osterskar, Sweden

[73] Assignee: AB Piab, Sweden

[22] Filed: Oct. 6, 1975

[21] Appl. No.: 620,627

[30] Foreign Application Priority Data

Oct. 16, 1974 Sweden ..... 7413016

[52] U.S. Cl. ..... 417/390; 417/395

[51] Int. Cl.[2] ..... F04B 43/06

[58] Field of Search ..... 417/392–395, 417/390

[56] References Cited

UNITED STATES PATENTS

| | | | |
|---|---|---|---|
| 2,780,066 | 2/1957 | Tarry | 417/395 |
| 3,357,360 | 12/1967 | Borell | 417/395 |
| 3,460,482 | 8/1969 | Jackson | 417/395 |
| 3,514,227 | 5/1970 | Rupp | 417/395 |

*Primary Examiner*—Carlton R. Croyle
*Assistant Examiner*—G. P. La Pointe
*Attorney, Agent, or Firm*—Ladas, Parry, Von Gehr, Goldsmith & Deschamps

[57] ABSTRACT

Pump comprising reciprocating pumping means driven by a periodically varying pressure in a hydraulic or pneumatic driving device. The driving device comprises an ejector supplied with a driving medium causing alternating pressure reductions and increases in a pressure chamber by driving a valve body to and from an initial position, the pressure variations in the pressure chamber acting on the pumping means for reciprocating movement thereof.

6 Claims, 2 Drawing Figures

PUMP HAVING RECIPROCATING PUMPING MEANS

Pumps having reciprocating pumping means, such as piston pumps and membrane pumps, are mostly driven by rotary motors or the like. In several cases this is involved with difficulties, e.g. in such cases where the pump has to be arranged in a location difficult to get at. This is the case if the pump is immersed in liquid. In the latter case also the driving motor normally is made immersable which gives rise to a more expensive embodiment of the motor. Alternatively there can also be provided a shaft, straight or flexible, which connects the pump to a remote motor. This is a relatively expensive provision which, further, easily gives rise to breakdowns.

In all the cases stated above the necessity to add a mechanism converting the rotary movement of the motor to the reciprocating movement of the pumping means has to be added.

The present invention relates to a pump having a reciprocating pumping means, in which the driving device is arranged in direct connection with the pump and in which the above difficulties are eliminated.

Further, the pump in accordance with the invention is particularly well adapted for use in such places where a pressure medium, e.g. pressurized air, is the source of power that most easily can be got at.

The invention has reference to a pump in accordance with the preamble of claim 1 which essentially is characterized by what is stated in the characterizing portion of claim 1.

Figure 1:
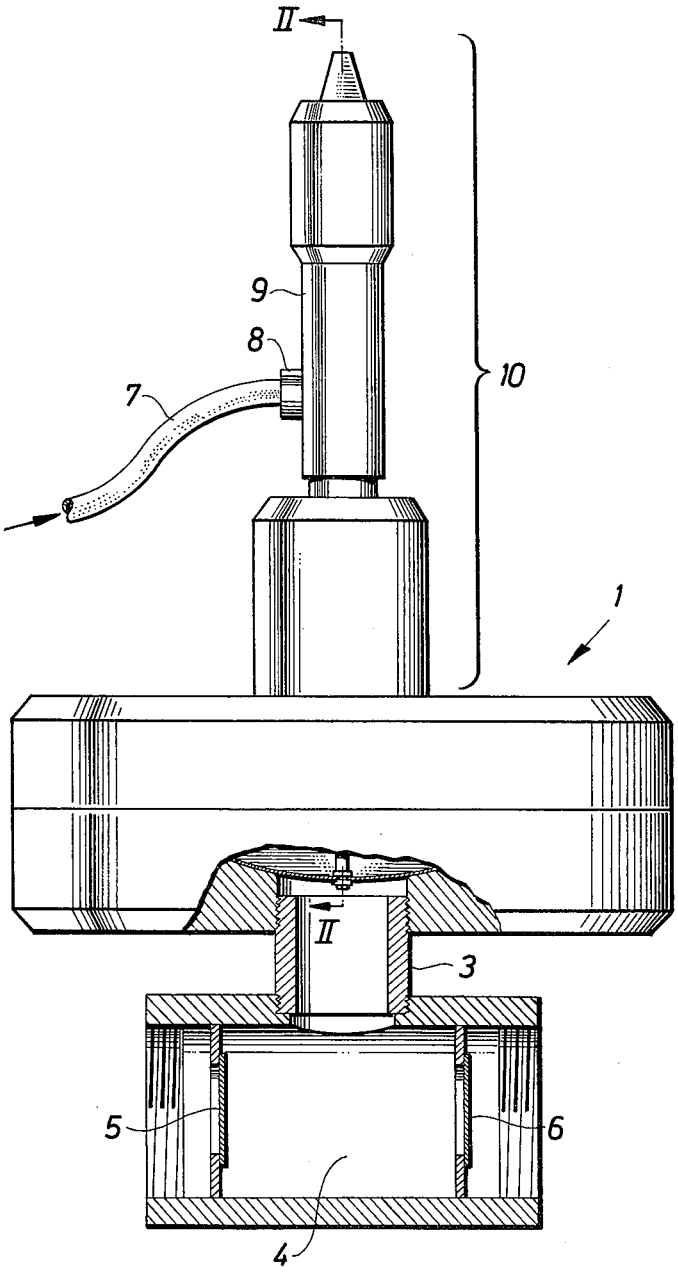
Figure 2:
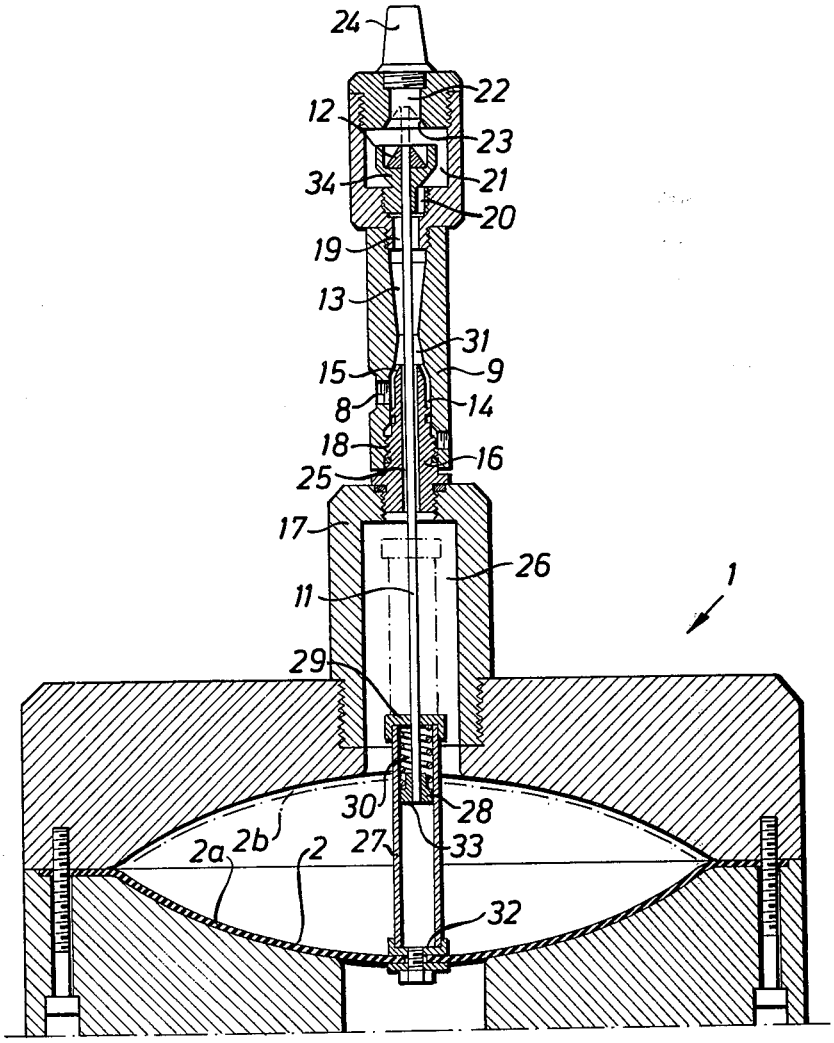

The invention will be described in the following with reference to the attached drawings, in which FIG. 1 is a side view of a pump in accordance with the invention, and FIG. 2 is a section through the device in accordance with FIG. 1 along line 2—2 seen in the direction of the arrows.

In the drawings reference designation 1 has reference to the housing of a pump chamber in which a reciprocating pumping means in the form of a membrane 2 is provided. The cavity of the pump chamber 1 is as usual divided into two compartments by the membrane 2. One of the compartments, the lower as seen in the drawing, is by a conduit 3 connected to a valve chamber 4 which as usual is provided with an inlet valve 5 and an outlet valve 6. An outer conduit can in per se known way be connected to the valve chamber 4 in order to obtain suction action on one side and pressure action on the other side.

The membrane 2 is given its reciprocating movement by subjecting it to pressure action and suction action by turns, on the side thereof faced from the valve chamber 4. For this reason the compartment of the pump chamber which in the drawing is located above the membrane 2 is in connection with an ejector device.

The ejector comprises a connecting pipe 7 for a driving medium which pipe 7 by the aid of a nipple 8 is connected to a recess in an ejector body 9. The ejector body 9 constitutes a portion of a longitudinal casing 10 surrounding a valve stem 11 one end of which is connected to the membrane 2 and the other end of which is connected to a valve body 12. The ejector body 9 includes a double-conical ejector channel 13 surrounding the valve stem 11 and accordingly, is of an annular cross-section. The connecting pipe 7 for driving medium opens into a space 14 of annular cross-section which by the aid of annular flow channel 15 is in connection with the double-conical ejector channel or chamber 13. The space 14 is formed as an interspace between an internal wall surface in a bore in the ejector body 9 and an outer wall surface of a longitudinal bushing 16 one end of which by threads is attached to a bigger bushing 17 which in turn is attached to the valve chamber 1. The annular flow channel 15 is arranged at the outer end of the bushing 16. The ejector body 9 is by threads 18 attached to the longitudinal bushing 16.

The end of the ejector chamber 13 which is faced from the inlet end is by an annular channel 19 surrounding the valve stem 11 and another narrower channel 20 and an extra pressure chamber 21 in connection with an outlet opening 22. The outlet opening 22 is provided with a preferably conically shaped valve seat 23 and the valve 12 can be brought into contact with this valve seat as will be described later on. Further, the outlet opening 22 is at its outer end preferably provided with a silencer, e.g. comprising a porous sintered body 24 or an exhaust pipe (when immersed into a liquid).

The bushing 16 surrounds with its bore the valve stem 11 with a space forming an annular channel 25 around the valve stem. Said channel connects the inlet end of the ejector chamber 13 with a cylindrical space 26 provided in the bigger bushing 17. Said space 26 constitutes a pressure chamber and is in direct communication with the upper compartment of the pump chamber 1.

The connection between the valve stem 11 and the membrane 2 includes a socket 27 attached to the membrane, in the interior of which socket a connecting yoke 28 is displacably arranged. The lower end of the valve stem 11 is rigidly connected to the connecting yoke 28. Between the connecting yoke 28 and a cap 29 attached to the lower end of the socket 27 and through which the valve stem 11 is displacable there is provided a compression spring 30.

When pressure medium is introduced through the connecting pipe 7 this is flowing into the ejector chamber 13 through the inlet channel 15 in connection with which a negative pressure arises in an area designated 31 in the ejector chamber and where the annular channel 25 opens into the ejector chamber. Said suction action propagates to the space 26 in the bigger bushing 17 and to the upper side of the membrane 2 in the membrane chamber 1. Accordingly, the membrane 2 starts to move upwards. Said movement continues until a land surface 32 in the bottom of socket 27 hits a land surface 33 constituting the lower end surface of the yoke 28. During the continued upwards directed movement of the membrane 2 the valve stem 11 is raised, whereby the valve body 12 will engage the conical valve seat 23 in the outlet opening 22. The outlet 22 from the ejector is closed when this had happened due to which fact the driving medium still flowing through the connecting pipe 7 and the inlet channel 15 now will give rise to a positive pressure in the ejector chamber 13 which positive pressure also will be prevailing in the area 31 of the ejector chamber. The positive pressure propagates throuh the annular channel 25 and the space 26 to the upper side of the membrane 2 due to which fact the membrane now will move downwards. During most of this movement the valve body 12 is retained in contact with the valve seat 23 due to the fact that said positive pressure has propagated also to the pressure chamber 21 through the channels 19 and 20. The pressure is acting on the lower plane surface of the valve body 12 around the valve stem 11. The movement downwards of the membrane 2 continues until the spring 30 has been completely or greatly compressed. The membrane 2 will then compulsorily bring the valve stem 11 therewith in its continued movement downwards, the valve body 12 then leaving the valve seat 23. The outlet 22 is then opened in such a way that the pressure in the pressure chamber 12 suddenly decreases. Due to the fact that there is no force now retaining the valve body 12 in its upper position the spring 30, which in this position is compressed, during loss of a minor portion of its compression will move the valve body 12 by leaps back to its position shown in FIG. 2. The whole device has now returned to the position shown in FIG. 2 and the cycle is repeated again.

In order to guarantee a movement by leaps of the valve body also when the membrane 2 is raised from the position shown in FIG. 2 and reaches its upper end position, the device can be so constructed that the pressure in the pressure chamber 21 is acting on the upper conical side of the valve body when it is in the position shown in FIG. 2. For this reason it is sufficient to let the valve stem 11 pass through a bore in a land means 34 with some clearance and to arrange a rather good sealing between the whole lower plane surface of the valve body 12 and the upper plane surface of the land means 34 with which the valve body is in contact when it is in the position shown in FIG. 2.

A number of modifications of the invention can be realized within the scope given by the patent claims. The membrane 2 can of course be made in another way than as a single membrane. It can be a so-called rolling membrane or a bellows membrane. The membrane 2 can also be substituted by a plunger provided in a cylinder. Further, the device giving the valve body 12 its movement by leaps can comprise a spring snapping into recesses in a portion or similar movable together with the valve. Further, the shape of the housing 1 of e.g. the pump chamber can be adapted to the space of said chamber in such a way that the thickness of the material can be less and hence, a lower weight can be obtained. The pump chamber 1 can also be of an essentially smaller diameter having the membrane 2 shaped differently so that the whole pump chamber and the socket shaped means enclosing the valve stem 11 and the ejector 13 is given the shape of a relatively narrow, longitudinal cylindrical body to which the pressure medium pipe 7 in a suitable way is connected. Further, the outlet opening 22 can be provided with a connection shaped as a conduit disposing the pressure medium from the environment.

Also other modifications of the invention may be suggested.

What I claim is:

1. A pump having reciprocating pumping means driven by a periodically varying pressure in a hydraulic or pneumatic driving device, the pump including a pumping chamber having an inlet valve and an outlet valve, said driving device comprising an ejector to which a driving medium is supplied, said medium passing through a suction channel which causes a pressure reduction in a pressure chamber communicating therewith, a valve body driven by the pressure variations in the pressure chamber being displaceable from an initial position to a position where said valve body closes an outlet provided for the driving medium and is disposed in a valve seat, whereby the driving medium being supplied to the pressure chamber through said suction channel causes the pressure in the pressure chamber to rise and the valve body is urged to return to the initial position after retaining force emanating from the pressure of the driving medium and acting on the valve body has been overcome, the ejector, once the valve body is returned to the initial position, allows a pressure reduction to be created in the pressure chamber whereby the pressure variations in the pressure chamber act on the pumping means of the pump so that the pumping means is displaced in a reciprocating movement, the pressure chamber is in direct communication with one side of the reciprocating means and said reciprocating means being a thin flexible sheet material, and the valve body being attached to one end of a displaceable valve stem the other end of which is attached to the reciprocating pumping means.

2. A pump in accordance with claim 1, characterized by the fact that the valve stem is surrounded by a connecting means connecting the pressure chamber to the valve seat, a space exists between the inner wall surface of the connecting means and the valve stem which communicates with an inlet conduit for the driving medium, said space defines an ejector channel located between the valve body and the reciprocting means.

3. A pump in accordance with claim 2, characterized by the fact that the pressure chamber constitutes a cylindrical space surrounding the portion of the valve stem closest to the pumping means and communicates with the reciprocating pumping means, and the pressure chamber accommodates a connecting means located therein which connects the valve stem to the reciprocating means.

4. A pump in accordance with claim 3, characterized by the fact that said connecting means includes a socket which is attached to the pumping means, a delimited displaceable connecting yoke slidably disposed in said socket which is attached to the end of the valve stem, a spring located within said socket whereby when the valve head is engaging said valve seat the valve stem is urged away from said valve seat.

5. A pump in accordance with claim 4, characterized by an extra pressure chamber surrounding said valve body and communicating with the driving medium flowing from the ejector.

6. In a hydraulically or pneumatically driven pump including a pump housing containing a reciprocable pumping means dividing the interior of the pump housing into a driving chamber subjected to the pressure of the hydraulic or pneumatic driving fluid and a pumping chamber for urging the medium to be pumped through an inlet valve and then through an outlet valve, the pumping means being reciprocatingly driven by the action of the varying pressure of the hydraulic or pneumatic fluid in the driven chamber in relation to the pressure existing in the pumping chamber, and including an ejector for producing a negative pressure, wherein the improvement comprises the fact that the ejector is directly connected to the pump housing, a valve stem extending from said pumping means through the ejector to a valve mechanism, said mechanism responsive to the position of the pumping means opens or closes a flow path from the driving chamber to the atmosphere, driving fluid under pressure is supplied to the ejector such that when said flow path is open the driving fluid under pressure flows out to the atmosphere whereby a negative pressure is created in the driving chamber and the pumping means is urged to one end position thereof and when said flow path is closed the driving fluid under pressure flows into the driving chamber and creates a positive pressure therein whereby the pumping means is moved to the other end position, the pumping means being connected to the valve mechanism by the valve stem to open and close said flow path.

* * * * *